US005545348A

United States Patent [19]

Savio

[11] Patent Number: 5,545,348

[45] Date of Patent: Aug. 13, 1996

[54] NON-PHOSPHATE HIGH CARBONATE MACHINE DISHWASHING DETERGENTS CONTAINING MALEIC ACID HOMOPOLYMER

[75] Inventor: Lenore E. Savio, Belle Mead, N.J.

[73] Assignee: Church & Dwight Co., Inc., Princeton, N.J.

[21] Appl. No.: 333,251

[22] Filed: Nov. 2, 1994

[51] Int. Cl.[6] ..... C11D 3/10; C11D 3/37

[52] U.S. Cl. ..... 510/230; 510/378; 510/476; 510/509

[58] Field of Search ..... 252/174.14, 174.24, 252/95, 99, 135, DIG. 2, DIG. 10, DIG. 11

[56] References Cited

U.S. PATENT DOCUMENTS

| | | | |
|---|---|---|---|
| 3,308,067 | 3/1967 | Diehl | 252/161 |
| 3,764,559 | 10/1973 | Mazuno et al. | 252/99 |
| 3,896,056 | 7/1975 | Benjamin et al. | 252/539 |
| 3,941,710 | 3/1976 | Gilbert et al. | 252/99 |
| 4,203,858 | 5/1980 | Chakrabarti | 252/135 |
| 4,265,790 | 5/1981 | Winston et al. | 252/532 |
| 4,608,188 | 8/1986 | Parker et al. | 252/99 |
| 4,652,392 | 3/1987 | Baginski | 252/109 |
| 4,820,441 | 4/1989 | Evans | 252/174.18 |
| 4,826,632 | 5/1989 | Blackburn et al. | 252/550 |
| 4,923,636 | 5/1990 | Blackburn et al. | 252/550 |
| 5,151,208 | 9/1992 | Huijben et al. | 252/174.14 |
| 5,152,910 | 10/1992 | Savio et al. | 252/95 |
| 5,152,911 | 10/1992 | Savio et al. | 252/95 |
| 5,268,119 | 12/1993 | Simpson et al. | 252/65 |
| 5,279,756 | 1/1994 | Savio et al. | 252/95 |
| 5,281,351 | 1/1994 | Romeo et al. | 252/99 |
| 5,281,352 | 1/1994 | Savio et al. | 252/99 |
| 5,332,519 | 7/1994 | Mazzola | 252/174 |
| 5,376,300 | 12/1994 | Bolkan et al. | 252/174.14 |
| 5,443,751 | 8/1995 | Mazzola | 252/174.13 |

FOREIGN PATENT DOCUMENTS 2109398 10/1981 United Kingdom .

*Primary Examiner*—Paul Lieberman
*Assistant Examiner*—A. Hertzog
*Attorney, Agent, or Firm*—Irving M. Fishman

[57] ABSTRACT

A non-phosphate machine dishwashing detergent composition comprising at least about 80 wt. % of a combination of alkaline carbonate, e.g., sodium carbonate, and alkaline bicarbonate, e.g., sodium bicarbonate, having a weight ratio of carbonate to bicarbonate of about 1:1 to 1:5, about 0.5 to 8.0 wt. % of a polycarboxylate polymer consisting of polymaleic acid as dispersant, and about 0.5 to 8.0 wt. % of a nonionic surfactant. The composition may also contain an oxygen bleach, e.g., sodium perborate, and an alkali metal silicate corrosion inhibitor, e.g., sodium silicate, as well as other additives. Use of the composition results in relatively low residue formation on articles being washed.

12 Claims, No Drawings

NON-PHOSPHATE HIGH CARBONATE MACHINE DISHWASHING DETERGENTS CONTAINING MALEIC ACID HOMOPOLYMER

BACKGROUND OF THE INVENTION

1. Field of the Invention

This invention relates to non-phosphate machine dishwashing detergents which provide excellent cleaning performance with a low degree of residue formation.

2. Information Disclosure Statement Including Description of Related Art

The following information is being disclosed under the provisions of 37 C.F.R. 1.56, 1.97 and 1.98.

In the detergent industry, distinctions are drawn between cleaning compositions on the basis of their functional utility. For example, there are considerable art-recognized differences between cleaning compositions that are used for laundering purposes; cleaning compositions that are used for machine dishwashing purposes; and cleaning compositions that are used for hand dishwashing purposes. Generally, cleaning compositions for laundering purposes employ high foaming organic surfactants as the main cleansing agents. Foaming, unless it is excessive to the extent that it causes overflow from the washing machines, is generally considered beneficial in laundering compositions because it provides an indication to users that the product is working. By way of contrast, machine dishwashing methods which are currently used to wash china, glass, porcelain, ceramic, metal, and hard synthetic articles impart a high mechanical impact of the wash liquid which is sprayed onto the articles to be cleaned. Recently, developments in dishwashing apparatus have been directed toward further increasing the intensity of liquid motion as well as the water volume cycled per minute, so as to further improve the mechanical cleaning effect of the cleansing solution. Compared to laundering compositions, however, machine dishwashing compositions are very low-foaming compositions inasmuch as foam formation interferes with the mechanical action of the dishwasher and reduces the mechanical impact of the liquid sprayed onto the articles to be cleaned. The surface active agents useful for machine dishwashing compositions should not only be low foaming materials, but they should also be foam depressants, so that the foaming caused by protein and food residues in combination with alkaline cleansing solutions is kept to a minimum. This situation, however, is quite different from hand dishwashing compositions, which, preferably, are high foaming and have more the attributes of laundering compositions.

Thus, machine dishwashing detergents constitute a generally recognized class of detergent compositions. In summary, machine dishwashing detergents are mixtures of ingredients whose purpose, in combination, is to emulsify and remove food soils; to inhibit the foam caused by certain food soils; to promote the wetting of dinnerware to thereby minimize or eliminate visually observable spotting; to remove stains such as those caused by coffee and tea; to prevent a buildup of soil films on dinnerware surfaces; and to reduce or eliminate tarnishing of flatware. Additionally, machine dishwashing detergents must possess these characteristics without substantially etching or corroding or otherwise damaging the surface of dinnerware and flatware.

It is conventional to use strongly alkaline solutions in institutional and household dishwashing machines for washing dishes, glasses and other cooking and eating utensils.

Ordinary tap water is used to make up the strongly alkaline cleaning solution and for rinsing purposes subsequent to the cleaning operation. However, spotting on dishes and glassware by hard water and soil residues and precipitates has been a major problem. Currently, these problems are minimized in machine dishwashing detergent compositions by the use of relatively high levels of polyphosphates to act as hardness sequestering agents, thus reducing the amount of hardwater deposits and filming on glassware. In addition, these detergents usually contain a chlorine bleaching system for stain removal and an added cleaning boost by oxidizing proteinaceous soils on glassware. Chlorinating agents also help prevent spotting.

Although the performance of these conventional detergent detergent compositions are quite satisfactory, high phosphate levels have potential environmental drawbacks. Furthermore, the addition of chlorine bleach requires special processing and storage and packaging precautions. Additionally, chlorine bleach imparts an undesirable odor and makes fragrancing the finished product more difficult.

In recent years, increased attention has been focused upon environmental pollution problems (e.g. water pollution). Phosphates have been identified as a contributing factor to eutrophication (i.e. promotion of algae growth) and considerable effort has been devoted to attempts at replacing all or at least some significant part of the alkaline condensed phosphates used in machine dishwashing detergents with chemicals that are more ecologically acceptable. Of the numerous compounds that have been tested as substitutes for alkaline condensed phosphates (particularly as substitutes for tripolyphosphate), very few chemicals have given promising results. Many chemicals lack the desired cleaning ability. Other chemicals lack the beneficial effect of the polyphosphates which promote cleaning even when used at levels lower than that required to sequester all the hard water metal ions present. Still others are too expensive to be practical.

It is not conventional in commercial practice to replace the condensed polyphosphates in dishwashing detergents with carbonate salts. Although carbonate salts are effective and economical water softeners, they remove water hardness ions by precipitation and as a result leave unacceptable levels of residue on the dishes, glassware and utensils being washed.

It is desirable, therefore, to provide a moderately alkaline, non-phosphate, non-chlorine automatic dishwashing detergent composition which provides excellent glassware spotting and filming results. It is especially desirable to provide a detergent composition which imparts glassware cleaning efficacy equal to that of conventional automatic dishwashing detergents which rely on phosphates and chlorine bleach to achieve the same results. It would also be desirable to provide a stable, less alkaline detergent composition which requires no expensive barrier packaging for extended shelf-life stability.

The following references may be considered relevant or material to the invention claimed herein.

U.S. Pat. No. 5,152,910 issued Oct. 6, 1992 to Savio et al., discloses low phosphate machine dishwashing detergents comprising 50 to 95 wt. % of carbonate and bicarbonate salts having a weight ratio of carbonate to bicarbonate of from about 1:1 to 1:5, an alkaline condensed phosphate salt in an amount of about 0.1 to 0.3 wt. % expressed as $P_2O_5$, about 0.5 to 8.0 wt. % of a blend of polymers comprising an acrylic homopolymer and a maleic anhydride/olefin copolymer, and about 0.5 to 8.0 wt. % of a foam suppressing nonionic surfactant.

U.S. Pat. No. 5,152,911, issued Oct. 6, 1992 to Savio et al., has a disclosure similar to that of U.S. Pat. No. 5,152,910 discussed in the preceding paragraph except that the disclosed compositions do not contain any phosphate component.

U.S. Pat. No. 5,268,119, issued Dec. 7, 1993 to Simpson et al., disclose low phosphate machine dishwashing detergents comprising 50 to 95 wt. % of carbonate and bicarbonate salts wherein the weight ratio of carbonate to bicarbonate is from 1:1 to 1:10, a condensed phosphate salt to provide 0.1 to 1.5 wt. % of $P_2O_5$, 0.5 to 5 wt. % of a polycarboxylate polymer and 0.5 to 5.0 wt. % of a foam suppressing nonionic surfactant.

U.S. Pat. No. 5,279,756, issued Jan. 18, 1994 to Savio et al., discloses non-phosphate machine dishwashing detergents comprising 5.0 to 50.0 wt. % of carbonate and bicarbonate salts having a weight ratio of carbonate to bicarbonate of from about 1:1 to 20:1, from about 2.0 to 60 wt. % of a hydrocarboxylic acid or salt, e.g. citric acid, about 0.5 to 8.0 wt. % of a blend of polymers comprising an acrylic or methacrylic polymer and a maleic anhydride/olefin copolymer, and about 0.5 to 8.0 wt. % of a foam suppressing nonionic surfactant.

U.S. Pat. No. 5,281,351, issued Jan. 25, 1994 to Romeo et al., discloses novel processes for incorporating an anti-scaling agent in zero-P or low phosphate built powder detergents. The detergents may contain up to 80% of a silicated alkali metal or ammonium or substituted ammonium inorganic non-phosphorous salt, e.g., up to 40% of sodium carbonate, sodium bicarbonate, sodium sequicarbonate, or mixtures thereof, and 10 to 40% liquid sodium silicate, and 0.5 to 6.0% of a nonionic surfactant. The anti-scalant agent may be polymaleic acid or its sodium salt.

U.S. Pat. No. 5,281,352, issued Jan. 25, 1994 to Savio et al., has a disclosure similar to that of U.S. Pat. No. 5,279,756 described previously except that the disclosed detergent compositions also contain an alkaline condensed phosphate salt to provide about 0.1 to 1.7 wt. % of $P_2O_5$.

SUMMARY OF THE INVENTION

The present invention is based upon the discovery that high levels of carbonate salts can be formulated together with low levels of a polycarboxylate polymer consisting of polymaleic acid, and relatively high levels of nonionic surfactants in a non-phosphate dishwashing detergent formulation to provide satisfactory cleaning without unacceptable spotting and filming and without the need to add phosphates and/or a chlorinating agent.

Accordingly, the present invention provides improved automatic dishwasher detergents comprising at least about 80, preferably from about 80 to 95 percent by weight of carbonate and bicarbonate salts having a weight ratio of between about 1:1 to 1:5 carbonate to bicarbonate, from about 0.5 to 8.0 percent by weight of a polycarboxylate polymer consisting of polymaleic acid as dispersant, and from about 0.5 to 8.0 percent by weight of a foam-suppressing nonionic surfactant.

While removal of phosphates from conventional dishwashing detergents containing approximately 20 percent by weight carbonate has not been practical due to more severe spotting and filming, surprisingly, we have found that all of the phosphate can be removed if polymaleic acid is added to the formulation. Indeed, the total level of carbonate can be increased to levels not normally used and yet with significantly reduced spotting and filming normally encountered with carbonate formulations, and in some instances improving performance even to the levels seen with high phosphate formulas.

DETAILED DESCRIPTION OF THE INVENTION

The carbonate and bicarbonate salts utilized in the detergent compositions of this invention may be for example alkali metal salts, i.e., sodium, potassium or lithium carbonates or bicarbonates, or ammonium salts, i.e. ammonium carbonate or bicarbonate. The alkali metal carbonates and bicarbonates are preferred and sodium carbonate and sodium bicarbonate are most preferred. The total of carbonate and bicarbonate salts in the composition is generally at least about 80 wt. %, preferably in the range of about 80 to 95 wt. % preferably about 80 to 90 wt. % based on the total dry weight of the composition, and the weight ratio of carbonate to bicarbonate salt is generally in the range of about 1:1 to 1:5, preferably about 1:1 to 1:3.

The polymaleic acid, i.e., homopolymer of maleic acid, generally has a number average molecular weight in the range of about 300 to 3000, preferably about 300 to 2000. The polymaleic acid may be prepared by conventional means by polymerizing maleic acid in the form of a solution and/or dispersion in an aqueous or organic solvent, e.g. xylene, polymerization medium. The polymaleic acid is generally present in the detergent compound in an amount of about 0.5 to 8.0 wt. %, preferably about 3.0 to 7.0 wt. %, based on the total weight of the dry composition, i.e., the total weight of components exclusive of water. The polymaleic acid is intended to be the only polycarboxylate polymer present in the composition.

The non-phosphate machine dishwashing compositions of the present invention also include from about 0.5 to 8.0 percent, and preferably, about 2.0 to 5.0 percent by weight of a foam-suppressing nonionic surfactant. Illustrative of such surfactants are the modified ethoxylated alcohol or alkyl phenol type, wherein the ethoxylate is modified by replacing the terminal OH group with halogen, for example, chlorine, or alkoxy, or with aryloxy and arylalkyloxy groups; amine polyglycol condensates; "Pluronic" surfactants obtained by the condensation of ethylene oxide with hydrophobic bases formed by condensing propylene oxide with propylene glycol, and the like.

Typical nonionic detergent active compounds which can be used in the compositions of the invention include ethoxylated fatty alcohols, preferably linear monohydric alcohols with $C_{10}$–$C_{18}$, preferably $C_{10}$–$C_{15}$, alkyl groups and about 5–15, preferably 7–12, ethylene oxide (EO) units per molecule and ethoxylated alkylphenols with $C_8$–$C_{16}$ alkyl groups, preferably $C_8$–$C_9$ alkyl groups, and from about 4–12 EO units per molecule. Specific nonionic detergents which may be employed herein include, by way of example, Plurafac RA 40 and RA 30 (manufactured by BASF), which are linear alcohol alkoxylates with varying amounts of ethylene oxide and propylene oxide; Pluronic L61 (manufactured by BASF), which is a block copolymer with a molecular weight of 2000; Polytergent S305LF and S405LF (manufactured by Olin Chemical), which are alkoxylated linear alcohols similar to Plurafac RA 40 and RA 30; and Polytergent P-17A (manufactured by Olin Chemical), which is an ethoxylated polyoxypropylene glycol.

$$RO-(CH_2\underset{\underset{R'}{|}}{C}HO)_x(CH_2CH_2O)_y(CH_2\underset{\underset{R''}{|}}{C}HO)_z-H$$

wherein R is a $C_{6-C10}$ linear alkyl mixture, R' and R" are methyl, x averages 3, y averages 12 and z averages 16. Such an alkoxylated linear alcohol is sold by BASF under the trademark "Industrol DW 5" and is described in U.S. Pat. No. 4,464,281, column 5, lines 55 et seq.

The nonionic compounds may be used in admixture with minor amounts of other detergent-active compounds to improve their characteristics.

It is preferred to include bleaching agents in the present invention. The preferred bleaching agents employed are classified broadly as oxygen bleaches. Preferably chlorine bleaches are not utilized herein. The oxygen bleaches are represented by percompounds which are true per salts or ones which liberate hydrogen peroxide in solution. Preferred examples include sodium and potassium perphosphates, perborates, percarbonates, and monopersulfates. The perborates, particularly sodium perborate, are especially preferred.

The oxygen bleach is employed in amounts of from about 0 to 8.0, and preferably, from about 1.0 to 6.0 percent by weight of the detergent formulation.

The peroxygen bleach may be used in conjunction with an activator therefor. Polyacylated-compounds may be used with perborates or other peroxygen bleaches as activators; tetraacetylethylenediamine ("TAED") is particularly preferred. Other useful activators include, for example, acetylsalicylic acid derivatives, pentaacetyl glucose tetraacetylglycoluril ("TAGU"), ethylidene benzoate acetate and its salts, alkyl and alkenyl succinic anhydride, and the derivatives of these.

A useful bleaching composition containing peroxygen bleaches capable of yielding hydrogen peroxide in an aqueous solution and specific bleach activators at specific molar ratios of hydrogen peroxide to bleach activator is disclosed in Chung et al, U.S. Pat. No. 4,412,934 assigned to the Proctor & Gamble Company.

Corrosion inhibitors can be added if desired. Soluble silicates are highly effective inhibitors and can be added to certain formulas of this invention at levels of from about 3.0 percent to about 15.0 percent by weight. Alkali metal silicates, preferably potassium or sodium silicates having a weight ratio of $SiO_2$:$M_2O$ of from about 1:1 to 2.8:1 can be used. M in this ratio refers to sodium or potassium. A sodium silicate having a ratio of $SiO_2$:$Na_2O$ of about 1.6:1 to 2.45:1 is especially preferred for economy and effectiveness.

Additionally, small amounts of conventional adjuvants such as perfumes, colorants, chlorinated bleaches, bacterial agents or other similar adjuvants can suitably be employed.

Such conventional additives are employed, generally in the amount of about 0 to 5.0, preferably 1.0 to 5.0 percent by weight. Such additives may also include aluminates and silicates for protection of the china, and foam suppressors.

Automatic dishwashing detergents ("ADDs") of the present invention are generally formulated as solid detergents. Although the present invention can be applied to or embodied in various types of machine dishwashing detergents, its greatest advantage is associated with the production of powdered or granular compositions.

In use, the amount of detergent composition added to the wash water will preferably be limited so that the dissolved solids of the composition do not exceed about 1 percent by weight of the wash water, the preferred concentration in the wash water being about 0.25 to 0.75 percent by weight. Concentrations of less than about 0.5 percent by weight are typically sufficient for good automatic machine dishwashing.

All the ingredients of this invention should be selected so as to provide a detergent which produces little or no foam during machine dishwashing, even in interaction with foamable food soils. Low-foaming or non-foaming ingredients can be used to help provide this freedom from excessive foaming, and, as pointed out previously, surfactants with low foam or even de-foaming properties are added to reduce or control foaming.

The following examples further illustrate the invention. All parts and percentages are by weight of the dry solids unless otherwise indicated.

EXAMPLE 1

A solid, granular automatic dishwashing detergent composition was prepared containing the following components at the indicated weight percentages: sodium bicarbonate alkaline agent—42.55%; sodium carbonate alkaline builder—42.55%; sodium perborate monohydrate oxygen bleach—2.80%; "Industrol DW5" nonionic surfactant—3.00%; "Britesil C-20" sodium silicate corrosion inhibitor having a silica/NaO mole ratio of 2.0–6.00%; "Acumer 4200" polymaleic acid dispersant sold by Rohm and Haas, prepared in an organic solvent based system and having a number average molecular weight of about 1000–2.00%; and fragrance—0.10%. The composition was prepared by initially mixing the sodium bicarbonate, sodium carbonate, surfactant and polymaleic acid in a Hobart mixer. The sodium silicate was added and the product was placed in an oven at 150° F. (65.6° C.) for 1.5 hrs. The product was then cooled to 80°–100° F. (26.7°–37.8° C.) after which the oxygen bleach was added.

The composition was tested for undesirable film formation on tumblers and utensils during washing by means of the methodology of ASTM 3556 using 300 ppm of hard water and 5 cycles of washing with ratings of results assigned on a scale of 1 to 5 wherein 1 indicates no film and 5 indicates a very heavy film. The test resulted in ratings of 2.0 for tumblers and 1.5 for utensils.

EXAMPLE 2

The procedure of Example 1 was repeated except that the polymaleic acid was "Sokalan PM-10" sold by BASF and prepared in an aqueous based system. The ratings obtained were 2.3 for both tumblers and utensils.

EXAMPLE 3

The procedure of Example 1 was followed except that the composition contained 4.00% of "Acumer 4200" polymaleic acid, 42.05% of sodium bicarbonate and 42.05% of sodium carbonate.

The rating scale utilized for assessing the results of this test in terms of residue formed was as follows:

0=no residue

1=barely perceptible residue

2=slight residue

3=moderate residue

4=heavy residue

5=very heavy residue

Based on this scale, the ratings obtained were 1.0 both for a glass and a knife.

EXAMPLE 4

The procedure of Example 3 was followed except that the 4% of polymaleic acid was "Belcleen 200" sold by FMC. The ratings obtained were 0.0 for a glass and 1.0 for a knife.

EXAMPLE 5

The procedure of Example 3 was followed except that the 4% of polymaleic acid employed was "Sokalan PM-10" sold by BASF. The ratings obtained were 1.8 for a glass and 3.0 for a knife.

It has been found that in most cases, the presence of polymaleic acid, i.e., maleic acid homopolymer as the only polycarboxylate polymer dispersant in an automatic dishwashing detergent composition containing at least 80 wt. % of an alkaline carbonate and alkaline bicarbonate wherein the weight ratio of carbonate to bicarbonate is with the range of about 1:1 to 1:5, results in the formation of particularly low amounts of residue on glass and utensils, as compared with the use as dispersant of known copolymers of maleic acid, e.g., copolymers of 60% maleic acid and 40% of acrylic acid and copolymers of maleic acid with an olefin. It has also been found that as the percentage of polymaleic acid in the composition is reduced, e.g., from 4 wt. %, and is supplemented by increasing amounts of sodium tripolyphosphate (STPP), e.g., up to 9 wt. %, the residue formation on articles being washed is not reduced and may actually increase.

I claim:

1. A non-phosphate machine dishwashing detergent composition comprising at least about 80 wt. % of a combination of an alkaline carbonate and an alkaline bicarbonate having a weight ratio of carbonate to bicarbonate of about 1:1 to 1:5, about 0.5 to 8.0 wt. % of a polycarboxylate polymer consisting of a homopolymer of maleic acid as dispersant, said homopolymer of maleic acid being the only polycarboxylate polymer present in the composition, and about 0.5 to 8.0 wt. % of a nonionic surfactant.

2. The composition of claim 1 comprising about 80 to 95 wt. % of said combination of carbonate and bicarbonate.

3. The composition of claim 1 wherein said weight ratio of carbonate to bicarbonate is in the range of about 1:1 to 1:3.

4. The composition of claim 1 wherein said carbonate is an alkali metal carbonate and said bicarbonate is an alkali metal bicarbonate.

5. The composition of claim 4 wherein said carbonate is sodium carbonate and said bicarbonate is sodium bicarbonate.

6. The composition of claim 1 wherein said homopolymer of maleic acid has a number average molecular weight of about 300 to 3000.

7. The composition of claim 1 wherein said nonionic surfactant is present in an amount of about 2.0 to 5.0 wt. %.

8. The composition of claim 1 containing about 1 to 8.0 wt. % of an oxygen bleach.

9. The composition of claim 8 wherein said oxygen bleach is sodium perborate.

10. The composition of claim 1 containing about 3.0 to 15.0 of an alkali metal silicate corrosion inhibitor.

11. The composition of claim 10 wherein said silicate is sodium silicate.

12. A process comprising washing dishes and utensils in an aqueous wash liquor containing the composition of claim 1.

* * * * *